US005750910A

United States Patent [19]

LoJacono

[11] Patent Number: 5,750,910

[45] Date of Patent: May 12, 1998

[54] APPARATUS AND METHOD FOR TUNING GUITARS

[75] Inventor: Richard J. LoJacono, Paso Robles, Calif.

[73] Assignee: Francis X. LoJacono, Sr., Laguna Niguel, Calif.

[21] Appl. No.: 569,574

[22] Filed: Dec. 8, 1995

Related U.S. Application Data

[63] Continuation-in-part of Ser. No. 206,395, Mar. 7, 1994, Pat. No. 5,481,956.

[51] Int. Cl.[6] ..... G10D 3/06

[52] U.S. Cl. ..... 84/314 N

[58] Field of Search ..... 84/314 N, 307, 84/297 R, 298

[56] References Cited

U.S. PATENT DOCUMENTS

| | | | |
|---|---|---|---|
| 2,846,915 | 8/1958 | Daria | 84/307 |
| 3,538,233 | 11/1970 | Compton et al. | 84/1.16 |
| 3,599,524 | 8/1971 | Jones | 84/312 |

*Primary Examiner*—Michael L. Gellner
*Assistant Examiner*—Shih-Yung Hsieh
*Attorney, Agent, or Firm*—Francis X. LoJacono

[57] ABSTRACT

An apparatus and method of tuning a string instrument such as an electric guitar which is commonly provided with a solid body structure and a fretboard, wherein the tuning apparatus includes an adjustable bridge provided with a plurality of adjustable saddle bridge members secured to the body of the guitar, and a nut having a plurality of adjustable nut saddle members mounted at the distal end of the fretboard adjacent the tension mechanism to which the strings are attached. The adjustment of the bridge saddle members establishes a true intonation of each string with respect to the twelfth fret and all of the intervals between the twelfth fret and the bridge. The nut saddle members are adjusted to establish a true intonation of each string with respect to the first fret and the intervening intervals between the first fret and the twelfth fret. The adjustment of both the bridge and the nut determines the length of each string and the longitudinal position of each string over the first and twelfth fret, whereby each string throughout its length is arranged so as to have a substantially "zero" cent condition.

6 Claims, 5 Drawing Sheets

APPARATUS AND METHOD FOR TUNING GUITARS

This is a Continuation-In-Part application of application entitled "An Apparatus And Method of Tuning Guitars And The Like", filed Mar. 7, 1994, Ser. No. 08/206,395, U.S. Pat. No. 5,481,956 by the inventor of the present application, Richard J. LoJacono.

BACKGROUND OF THE INVENTION

1. Field of the Invention

The present invention relates generally to an apparatus and method for tuning a string musical instrument and more particularly to an apparatus and method for tuning acoustical and electric guitars, wherein an adjustable bridge is used in combination with an adjustable nut to provide a perfectly tuned guitar.

2. Description of the Prior Art

The electrical guitar of today is far different from its early counterpart which was conceived approximately some forty years ago. Changes have been relatively slow in coming in the art when considering that today's guitar can not be perfectly tuned. As an example, the foundations for the modern concept of intervals were laid by the Greek scientist Pythagoras in the 6th century B.C. A combination of today's technology and very demanding players has made it necessary to vastly improve and refine all aspects of string instruments to better suit their needs.

Guitar tuning is based on the equal-tempered scale, in which the ratio of each successive semitone to the next is based on the twelfth root of two. The octave is divided into twelve equal semitones, and to achieve this end the frets must be precisely placed. The twelfth root of two equals 1.0594631 (correct to seven places) and it is this ratio of 1.0594631:1 which is used as the basis for computing semitone intervals in equal-tempered tuning.

Simply stated, the ratio 17:18, known as the "eighteen rule", indicates that if a selected string length is divided into eighteen parts the distance from the saddle of the bridge to the first fret will equal seventeen parts. The distance from the nut to the first fret will equal 1/18 of the string or scale length. If the remaining distance is again divided into eighteen parts, 1/18 of that distance will be the interval between the first and second frets. By continuing on for each fret, the fret positions for the entire fingerboard can be laid out.

However, it is well known in the art that with the placement of the frets, as indicated above, it is still not possible to perfectly tune classical guitars, acoustic guitars or electric guitars, wherein all the strings will play in perfect harmony. This will be discussed in more detail in the following description.

The length of each string is now adjustable between the bridge and the fixed nut. This has been brought about by the use of an adjustable bridge device, wherein the bridge is provided with adjustable saddles on which the strings rest. This then establishes a means for allowing each string to be adjustably compensated at the bridge saddle according to it's length, tension, mass per unit length (diameter), and material that comprises the string. (See Physics For Scientist & Engineers, 2nd Edition, Chapters 18.1–18.4). That is, one can set the length of each string by adjusting the respective saddle that the string engages so as to establish a set length for its particular harmonic value. However, it is important to understand that it has been found that the lengthening or the shortening of the strings by means of an adjustable bridge does not affect in a positive manner the acoustics of a tone or sound (which is determined by the frequency of the vibration of the sound waves reaching the ears) for that portion of each respective string between the twelfth fret and the first fret and its respective interval. In other words, only the twelfth fret and the intervening frets and intervals located between the adjusted saddles of the bridge and the twelfth fret are affected in a positive manner. The length of each string only changes between the fixed nut and the adjustable saddle, and thus the longitudinal position of the strings does not change with respect to the fixed position of the nut and the first fret and the intervening frets, and intervals located between the fixed nut and the twelfth fret. And, oddly enough, therein lies the problem which has been solved by the present invention after long and tedious research. Until now the strings of a guitar have only been adjusted for a given length in one direction, whereby the length of each string is defined between the fixed nut and the bridge.

It is important that it be stressed that, until now, there has been no indication that anyone skilled in the art has given any consideration to adjusting both the nut end and the bridge end of each string. Accordingly, the dual end adjustment of the strings, as disclosed herein, allows for the first time a defined length of string to be positioned longitudinally relative to the fixed frets and their corresponding intervals. The need for longitudinally shifting the location of each individual string relative to the fixed frets along the neck of a guitar has not been recognized or even considered in the known art. As long as the strings are fixed at the nut, even though they are adjustable at the bridge, they are not capable of being selectively positioned longitudinally along the neck of the guitar so as to correspond to the position of the frets, particularly with respect to the first and twelfth intervals.

The chords in the first position, especially E, D, C, and G will sound out of tune when played. Any guitar in current use that employs a fixed straight nut, no matter how expensive the guitar might be, cannot play the first interval correctly and will therefore be out of tune. This is true no matter which one of the many tuning methods might be employed by the player.

It is important to note that an equal-tempered tuning method is the basic system used because most, if not all, electric guitars are constructed to play in equal temperament. This means that perfect intervals and chords in all keys are an impossibility with what is available in the art today.

Most, if not all, guitar players prefer that their instruments intonate correctly, that is to say, that their guitars play equally in tune at all points on the keyboard (fingerboard). However, no existing adjustable bridge alone can possibly achieve such a setting. Moreover, adjustable bridges that are in use today cannot correctly adjust string intonation.

All adjustable bridges set intonation by lengthening or shortening each string so as to align the string so that it can intonate correctly on its corresponding octave on the twelfth fret. Although this will closely intonate strings from the twelfth fret to the bridge, it has little or no affect on strings closer to the fixed nut which is the most often played area of the instrument.

Until late in this century, the tuning of a string instrument was not given any serious thought and thus the principle concept of tuning a guitar has been almost solely directed to employing an adjustable bridge device as previously described. Virtually every aspect of the electric guitar has been improved and upgraded by present technology standards from various body materials to state-of-the-art electronics and ergonomic contours. Yet the fretboard and its interval design has remained the same, notwithstanding material improvements only.

There are many arrangements of adjustable bridge devices which one can find in the following U.S. Patents:

| | |
|---|---|
| U.S. Pat. No. 2,740,313 to T. M. McCarty | U.S. Pat. No. 4,236,433 to Stephen Holland |
| U.S. Pat. No. 4,281,576 to C. Leo Fender | U.S. Pat. No. 4,373,417 to Gregg Wilson et al |
| U.S. Pat. No. 4,541,320 to Michael N. Sciuto | U.S. Pat. No. 4,867,031 to C. Leo Fender |

All of the above patents as well as all instruction books from how to play a guitar to how to tune a guitar have never mentioned or even suggested the incorporation of the present device as herein described and claimed.

SUMMARY AND OBJECTS OF THE INVENTION

A novel apparatus and method of tuning string instruments such as guitars, and more particularly all types of electric guitars which are commonly provided with solid body structures. For simplicity the word "guitar" will be used to represent all types of string instruments because the present invention is compatible with various types of acoustical guitars and other similar string instruments. The novel tuning apparatus comprises the combination of an adjustable bridge in which there is provided a plurality of adjustable saddle members secured to the body of the guitar and a nut having a sinusoidal configuration mounted on the distal end of the neck adjacent the tension mechanism to which the strings are attached. A plurality of adjustable nut saddle members are mounted in a nut frame of the adjustable nut, wherein the number of saddles in the nut and bridge correspond to the number of strings employed with a particular guitar. The bridge saddle members are first adjusted to establish as true an intonation as possible with respect to each string at or over the twelfth fret. The adjustment of the bridge saddles will basically affect all of the intervals between the twelfth fret and the bridge. The intonation of each interval of each string located between the twelfth fret and its associated bridge saddle is set to substantially provide as close to a "zero" cent reading as possible on a Stroboconn. This instrument calibrates in one cent intervals (one hundred cents between successive semitones) and determines the actual amount of error. The nut saddle members are then adjusted to provide a "zero" cent reading at the first interval or fret, whereby the precise intonation thereof is located over the first fret. The adjusting of the nut saddle primarily affects only the intervals defined by the first fret down to the twelfth fret, the first fret being the fret closest to the nut. Sometimes a reciprocating adjustment is needed between the adjustable saddle bridges and their respective adjustable saddle nuts to create a true "zero" reading by a Stroboconn on all the strings throughout their entire length. Because of the different string gauges and their required tension to raise a string to its proper pitch, the string length must be adjusted at the bridge and at the nut, not only to provide its proper value, but at the same time to shift and correctly position each string longitudinally over all the frets, and more particularly over the twelfth and first fret. This procedure takes the element of guesswork out of perfectly tuning a guitar which has never been accomplished in the past.

Accordingly, it is an important object of the present invention to provide a means by which a guitar can be properly tuned, that is, to establish pure tuned intervals over the entire length of each string by using an adjustable nut in combination with an adjustable bridge.

Another object of the present invention is to provide an apparatus and a new method of tuning a guitar by which all intervals and chords in all keys can for the first time be perfectly tuned over the entire fretboard of a guitar so as to have a perfect "zero" cent reading.

Still another object of the invention is to provide an adjustable nut that adjusts the size of the first interval, whereby the distance between each nut saddle and the first fret can be individually set for each string so as to determine its precise intonation on the first fret. By adjusting the first interval correctly in this manner all notes on all strings will be intonated correctly on their corresponding frets from the nut through the twelfth fret. This specifically solves the problem with any and all guitars in the current known art that use fixed straight nuts which do not allow the first interval to play correctly in tune, thereby preventing the intervals between the first and twelfth frets to be in tune. Therefore, employing an adjustable nut or a fixed nut having a selected sinusoidal configuration allows one to tune the intervals that are the most used by the player, whether he or she be a novice or a seasoned professional.

The present invention can now provide any guitar, regardless of its cost, with the capability to play first-position chords with proper interval pitch, whereby fingered notes will coincide with their open-note counterparts.

A further object of the present invention is to provide an apparatus of this character that is easy to install, service and maintain.

It is still another object of the invention to provide an apparatus of this type which is inexpensive to manufacture and install, and whereby all guitars now in use can also be readily retrofitted therewith.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Novel features and advantages of the present invention in addition to those mentioned above will become apparent to those skilled in the art from reading the following detailed description in conjunction with the accompanying drawings wherein.

DETAILED DESCRIPTION OF THE INVENTION

Figures 1, 2, 3, 4, 5:
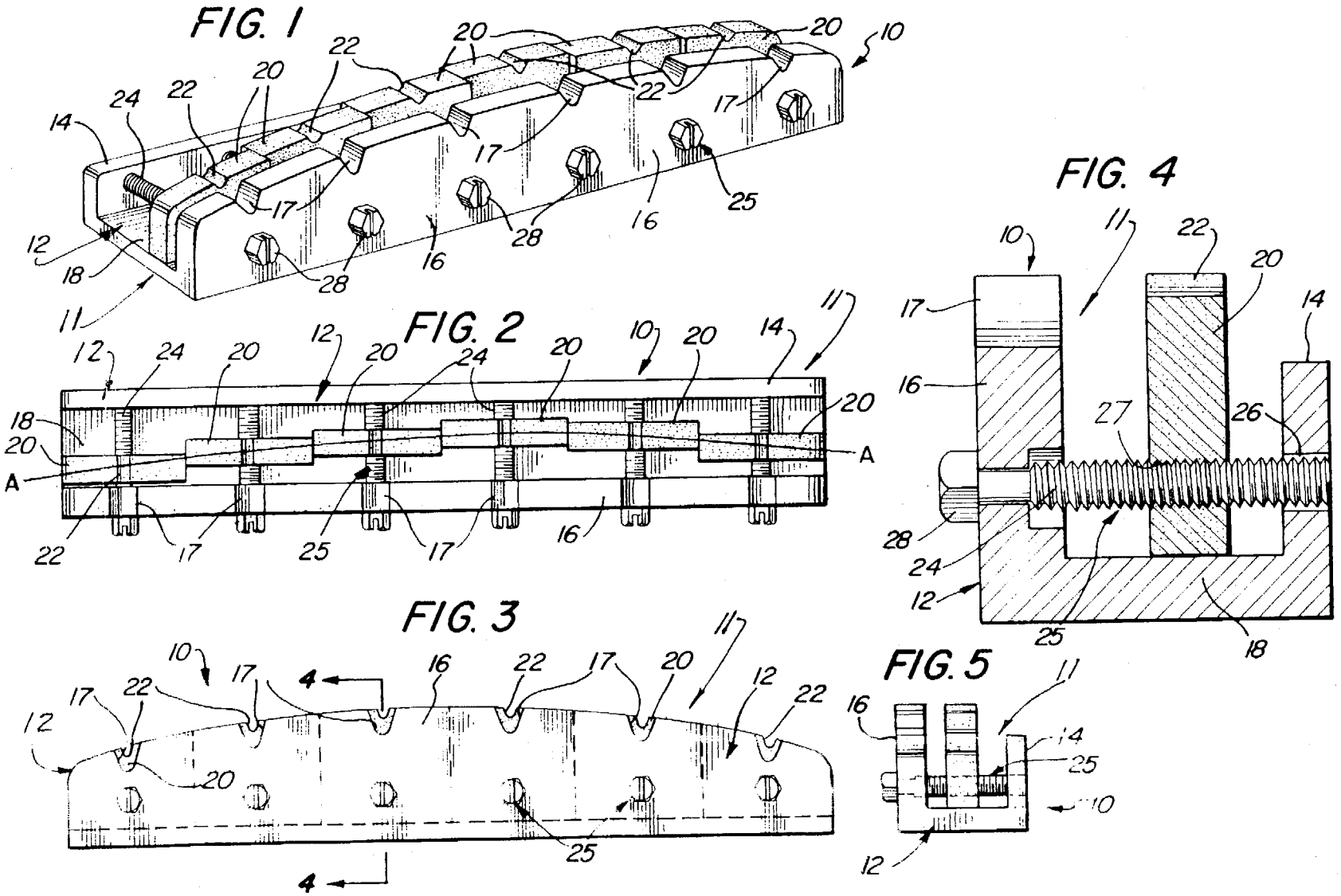
FIG. 1 is a perspective view of an adjustable nut apparatus of the present invention.
FIG. 2 is an enlarged top-plan view of the adjustable nut indicated in FIG. 1.
FIG. 3 is a front-elevational view of the adjustable nut illustrated in FIG. 2.
FIG. 4 is an enlarged cross-sectional view taken substantially on line 4—4 of FIG. 3.
FIG. 5 is a right side-elevational view of the adjustable nut.

Referring now to FIGS. 1 through 5 and more particularly to FIG. 1, there is shown an enlarged perspective view of one embodiment of the present invention which defines an adjustable nut means, generally indicated at 10, that replaces the typical fixed straight nut used in conjunction with various types of guitars. The adjustable nut means comprises a nut carriage, designated generally at 11, which is defined by an elongated channel member 12 arranged to be positioned transverse the terminating end of a fretboard 35, wherein the adjustable nut means is mounted between the first fret 44 of the guitar and the tensioning means, generally indicated at 42. Channel member 12 is formed with a front wall 14 and a rear wall 16 which projects above the front wall with its outer edge having an arcuate shape in which a plurality of deep notches 17 are disposed. Both walls 14 and 16 are integrally connected to a base member 18. The number of notches 17 are determined by the number of guitar strings used with a particular guitar. For simplicity, there are shown six notches to accommodate the number of strings commonly found in both acoustical and electric guitars. It should be noted that nut carriage 11 can be made from any suitable material such as brass or a strong plastic or nylon.

Adjustably mounted between the front wall 14 and the rear wall 16 are six adjustable, juxtaposed, nut saddle members 20, each having a groove 22 adapted to receive a respective string and aligned with its respective notch 16 of the rear wall 14, which is clearly illustrated in FIGS. 2 and 3. The grooves 22 are formed with a shallower depth compared to notches 17. This allows the guitar strings to seat firmly in nut saddles 20 without touching either the lower front wall 14 or rear wall 16. Preferably, the nut saddles will be made from a carbon material or other suitable materials. Various adjustable means, generally indicated at 25, may be employed, but there is a simple screw 24, illustrated in FIGS. 1 through 5, which is rotatably mounted in rear wall 16, extends to front wall 14, and is received in aperture 26. A screw head 28 is provided in order to adjust screw 24 so that each nut saddle member 20 can be readily adjusted during the tuning of its respective guitar string. That is, screw 24 is threaded into a corresponding threaded bore 27 so that the nut saddle member 20 can be adjusted laterally between the front and rear walls of the channel.

The saddle members 20 are closely fitted adjacent each other so as to rub against their respective side walls. This provides a stabilizing means to prevent movement of the saddle members when the strings are stroked.

Figure 6:
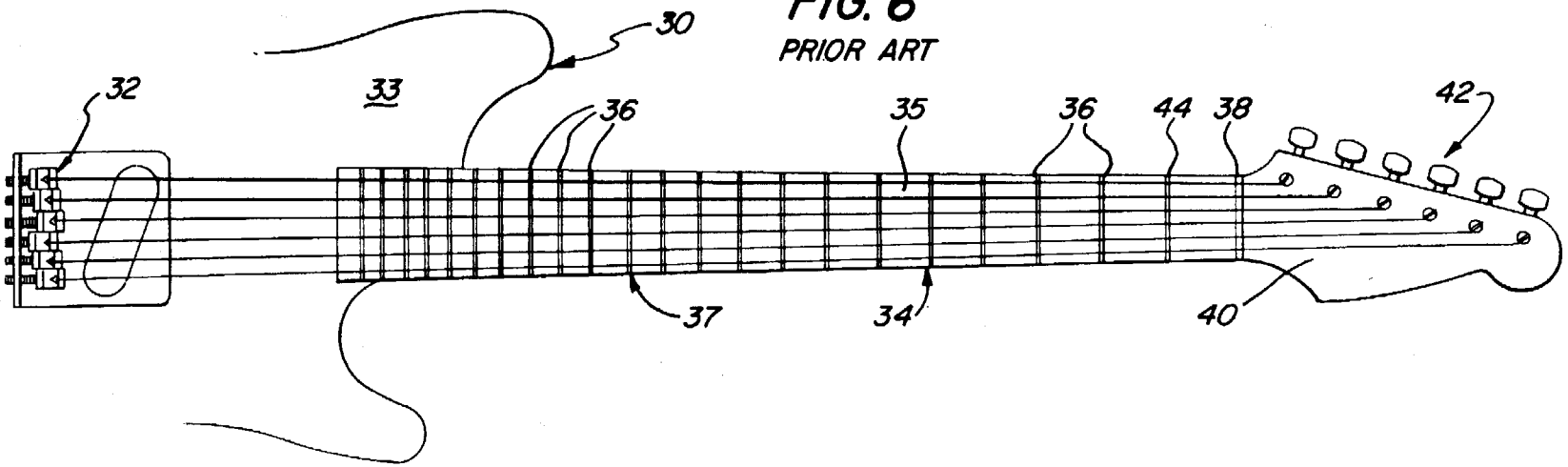
FIG. 6 PRIOR ART
FIG. 6 is a diagrammatic top-plan view of a prior-art guitar having an adjustable bridge and a typical fixed nut.
Figure 6A:
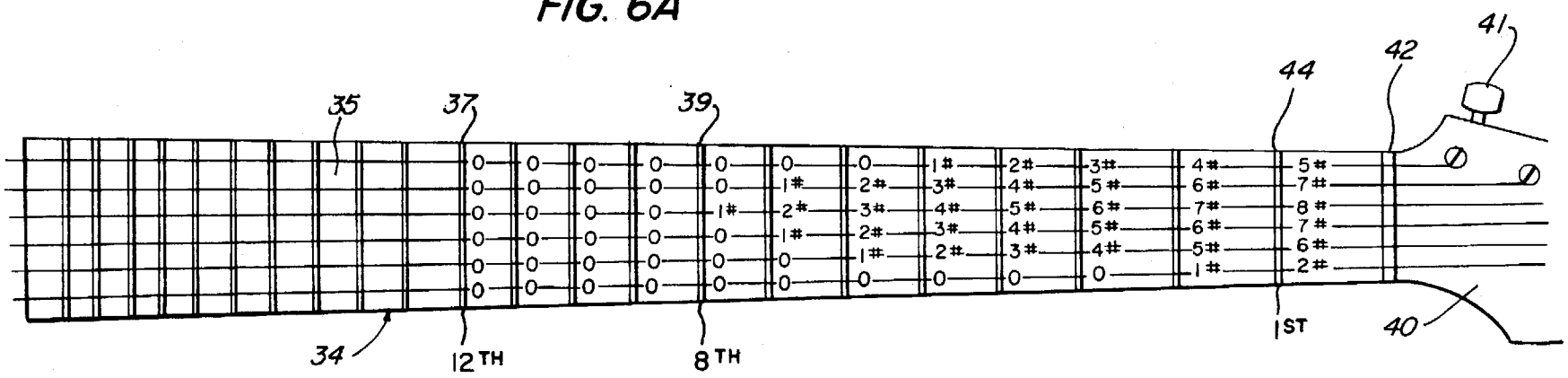
FIG. 6A is a diagrammatic view of a prior-art guitar after it has been tuned with a strobe tuner.

Referring more particularly now to FIG. 6, there is illustrated a typical prior-art guitar, indicated generally at 30, having typically six strings mounted to an adjustable bridge 32 affixed to the guitar body 33 to which is secured a neck 34. A typical fretboard 35 includes a plurality of fixed transverse fret members 36, comprising a twelfth fret 37 and a first fret 44, and a typical fixed nut 38 located at the outer terminating end of fretboard 35 from which extends a head member 40. A string tensioning means, indicated by numeral 41, is operably mounted to head 40. To date, all acoustical and solid-body guitars employ a fixed nut 38 mounted at the end of neck 34 adjacent first fret 44. It is important to note that an adjustable bridge affects only the intervals between bridge 32 and the twelfth fret 37, and that when tuning a guitar of the prior art that includes an adjustable bridge 32 only the intervals between the bridge 32 and twelfth fret 37 are effectively tuned to a substantially "zero" cent reading. This is clearly illustrated in the diagrammatic view of FIG. 6A, which indicates the results of a guitar that has been tuned using an electronic strobe tuning device (not shown). It should be noted that from the eighth fret 39 to the first fret 44 the amount of cents that each string is out of tune with the lower portion of the fretboard, also known as a fingerboard, is indicated by the symbol #.

Accordingly, since approximately 95% of chords are played above the twelfth fret 37, that is, between first fret 38 and twelfth fret 37, this proves that a perfect harmony can never be fully achieved by employing only an adjustable bridge which has been the case until now. The adjustable bridge was first introduced by Gibson Inc. approximately in the year of 1956 and no further refinement has been forthcoming until the present method of providing an adjustable nut or a nut having a selected sinusoidal configuration, as will hereinafter be described.

Figure 7:
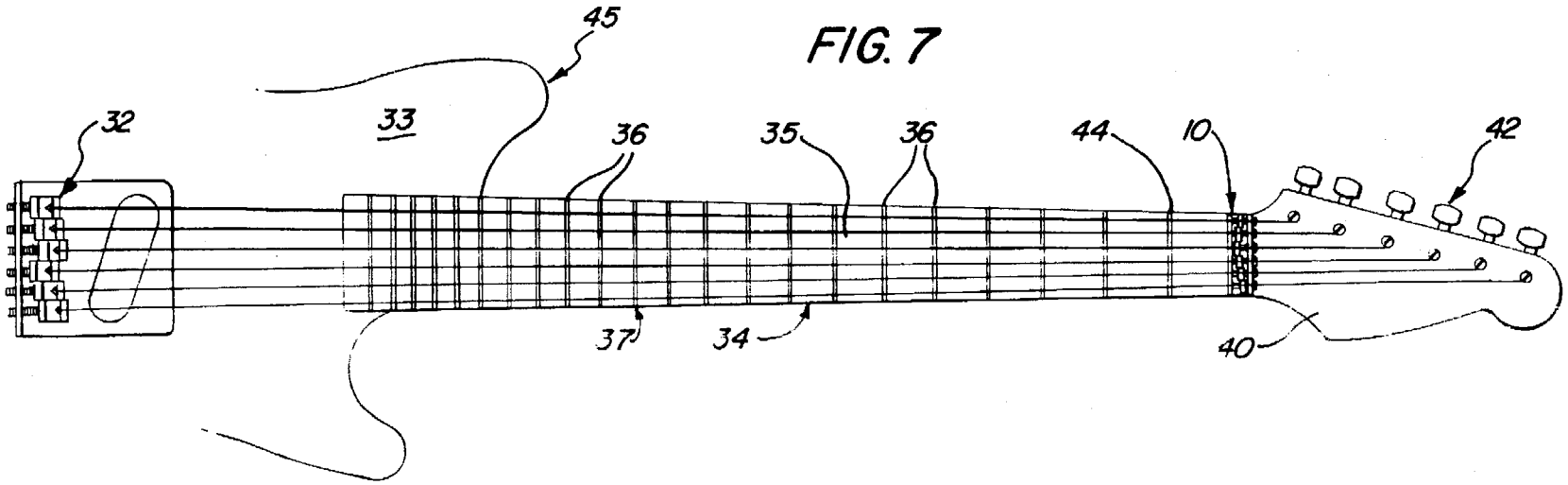
FIG. 7 is a diagrammatic top-plan view of a guitar having a typical adjustable bridge in combination with the novel adjustable nut of the present invention.

Referring now to FIG. 7, there is shown a guitar, generally indicated at 45, which is similar to guitar 30, as illustrated in FIG. 6. However, guitar 45 includes adjustable nut means 10, which is typically positioned adjacent the terminating end of fretboard 35, in proximity to first fret 38 so as to operate in cooperation with an adjustable bridge means 32. Each guitar string is attached to its respective bridge saddle and extends over the length of keyboard 37 so as to be mounted on and engaged with its respective nut saddle 20, as previously described above. Accordingly, by using adjustable nut means 10 in place of the age-old fixed nut the strings of a guitar can now be perfectly tuned to a "zero cent" reading, whereby all of the chords played will be in perfect hormony after the corresponding adjustments are made to both the adjustable bridge 32 and adjustable nut 10. It can thus be readily recognized by this disclosure that an adjustable bridge will only adjust the lower portion of the strings, and an adjustable nut, which has never before been used before in the art, provides the necessary means to separately adjust the upper portion of the strings. This is the first time a guitar of any type has been allowed to be perfectly tuned so as to be played in total harmony along the entire length of its keyboard by adjusting both ends of the guitar strings.

Figure 8:
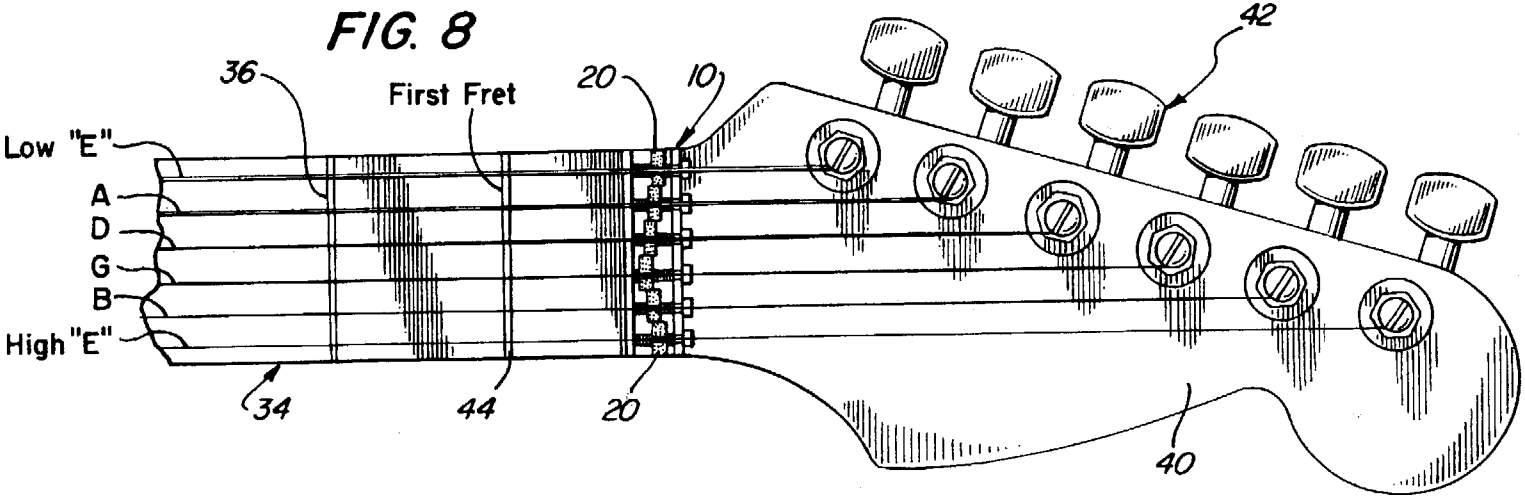
FIG. 8 is an enlarged top-plan view of the adjustable nut mounted between the first fret and the string tension screws, wherein the adjustable nut is shown in a typical adjusted sinusoidal configuration.
Figure 9:
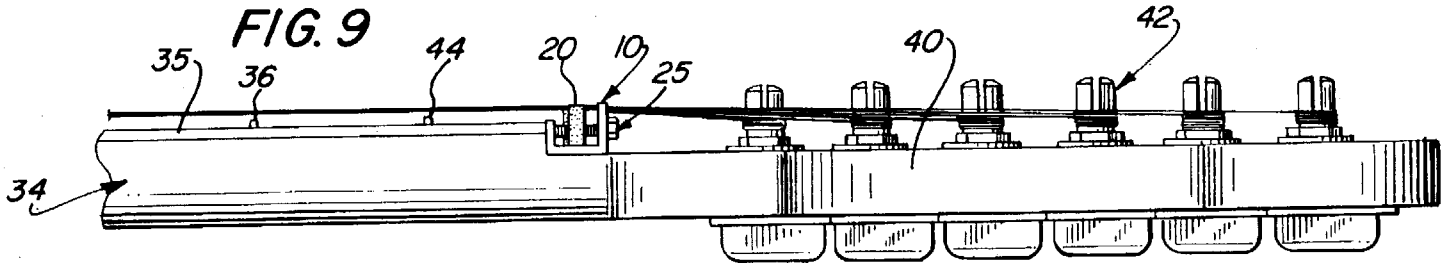
FIG. 9 is a side-elevational view of FIG. 8.

However, the following also establishes a unique method of tuning a guitar. In FIG. 8, there is illustrated an enlarged top-plan view of the adjustable nut end of the guitar which comprises the distal end of neck 34 and head 40 which includes string tensioning means 42. There are six guitar strings mounted over and engaging with each respective nut saddle 20. The first string is indicated as Low "E" followed typically by strings "A", "D", "G", "B" and High "E". As mentioned above, there are various criteria that must be kept in mind when each string is to be tuned. That is, one needs to compensate for the length of the guitar string, for the tension of the guitar string, and the diameter of the string, which is commonly referred to as the "mass" of the string. These statistical requirements can be found in Physics For Scientists & Engineers, 2nd Edition, Chapters 18.1–18.4, as mentioned heretofore. However, a more important aspect of the formula is the adjustment of each string at the nut. Nowhere is this indicated or suggested in the above or other such physics material when considering the tuning of a guitar to a perfect pitch. It is taught therein that only one end of each string is adjusted and that is the end that is attached to the adjustable bridge, while the opposite fixed ends of the guitar strings are defined as fixed. The fixed ends of the guitar strings are defined by their engagement with the fixed nut. This arrangement only establishes the required length of the strings but does not provide in any way for the need to longitudinally position each string over the length of the fretboard. More specifically, each individual guitar string from Low "E" to High "E" must be adjustably positioned in order that the specific length of each guitar string is longitudinally positioned over the fretted keyboard so that the length of each string is positioned with respect to the twelfth and first fret, 37 and 44 respectively. This can only be accomplished by having an adjustable nut 10 or a fixed nut having a selective sinusoidal configuration, as indicated by line A—A in FIG. 2, which however is not the preferred form of the invention. Accordingly, the longitudinal position of each specific guitar string will change relative to the given length that is determined by the selective setting of the nut saddles and bridge saddles so that the length of each guitar string is properly located over the first to the twelfth fret and the respective frets and intervals.

Figure 10:
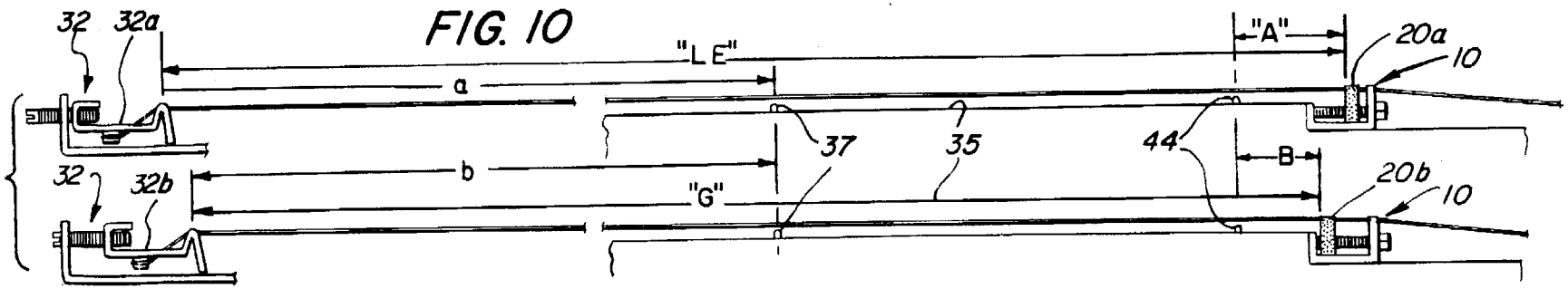
FIG. 10 is a schematic view of a pair of guitar strings, one above the other, each extending from an adjustable nut to an adjustable bridge wherein the length of each string is positioned relative to the first fret and the twelfth fret according to the string's tension and diameter.

With this in mind, we now refer to FIG. 10 which includes a first schematic diagram showing the length of the Low "E" string, which is indicated by the line marked LE, and a second schematic diagram showing the length of the "G" string, which is indicated by the line marked "G". These two diagrams are presented so that one may more readily understand how the strings are adjusted for length, and more particularly how the guitar strings are automatically positioned longitudinally over the first to the twelfth frets.

Referring now to the Low "E" string schematic, wherein the Low "E" string substantially represents the longest string, there is shown a bridge 32, one end of the Low "E" string being fixedly attached to an adjustable bridge saddle **32*a* and an adjustable nut 10, and the opposite end of the Low "E" string being engaged with a respective adjustable nut saddle 20**.

Preferably, the first adjustment is made by selectively positioning bridge saddle **32*a* to the twelfth fret so as to establish a "zero" cent reading over the twelfth fret and its respective interval. This distance is indicated by line "a" extending between bridge saddle 32*a*. and the twelfth fret 37. Positioning should be done with the assistance of a suitable strobe tuner (not shown). This is followed by adjusting saddle nut 20*a* with respect to first fret 44 so as to establish a "zero" cent reading at the first fret and its respective interval, the distance being indicated by line "A" extending between first fret 44 and nut saddle 20*a***. Accordingly, each of the intervening frets and intervals between the first fret and the twelfth fret will read a corresponding "zero" cent.

The lower schematic view of FIG. 10 represents the position of a shorter string which is defined as the "G" string, and is indicated by line "G" extending between adjustable bridge saddle **32*b* and adjustable nut saddle 10*b*. Line "G" is shorter than line "LE" and has a shorter line "b" than line "a" of the Low "E" string. That is, the distance from bridge saddle 32*b* is also closer to the twelfth fret 37 and the nut saddle 20*b***. Thus, once the length of a string is determined and set, it is automatically positioned longitudinally according to its length and set to a "zero" cent position with respect to the first and twelfth fret. This is the first time that both ends of the guitar strings are provided with a means to individually adjust properly the full length of each string, and a means to adjust each string longitudinally with respect to the first fret and twelfth fret and their respective intervals, whereby all frets and their respective intervals can be tuned to a "zero" cent reading which heretofore has not been accomplished with any guitar found in the art.

Referring again to FIG. 2, there is also illustrated a plurality of adjustable saddle nuts 20. When all the guitar strings are properly tuned to a perfect "zero" cent, the saddle nuts will define a substantially sinusoidal configuration, indicated by line A—A, extending over the juxtaposed saddle nuts 20. It is important to note that the configuration of sinusoidal line A—A will change according to the different designs of various name brand guitars and their associated types of guitar strings that might be used by specific guitar manufacturers. As an example, there are steel, plastic, nylon and wound strings, each of which has its own respective diameter or mass. Thus, it should be recognized at this time that it is possible to provide a fixed nut having a selected sinusoidal configuration if the guitar has its original structure or string components. However, a fixed sinusoidal nut is not conducive for commercial electric guitars as players of these types of guitars often switch to different guitar strings. To achieve a perfectly tuned guitar with a fixed nut it must have a specific sinusoidal configuration that would be compatible to each guitar based on a given overall scale length which is specific to that guitar. However, it is contemplated that classical guitars which often use only nylon strings could very well employ a fixed predetermined sinusoidal configuration as that indicated by line A—A of FIG. 2. Due to the well known "eighteen rule" used by guitar makers for laying out scales for fretboards, the nut configuration can be determined and set for the first interval and then the rest of the fretboard will remain in perfect tune. This applies only when the bridge is set so that the twelfth fret interval is in perfect tune.

Referring now to FIGS. 11 through 15, there is disclosed a second embodiment of the present invention which defines an adjustable nut device, generally indicated at 50. The adjustable nut device comprises a nut carriage 52 formed as an elongated channel member 54 which is formed by a front wall 56 and a rear wall 58, wherein the walls are integrally formed with a base member 60.

Figure 11:
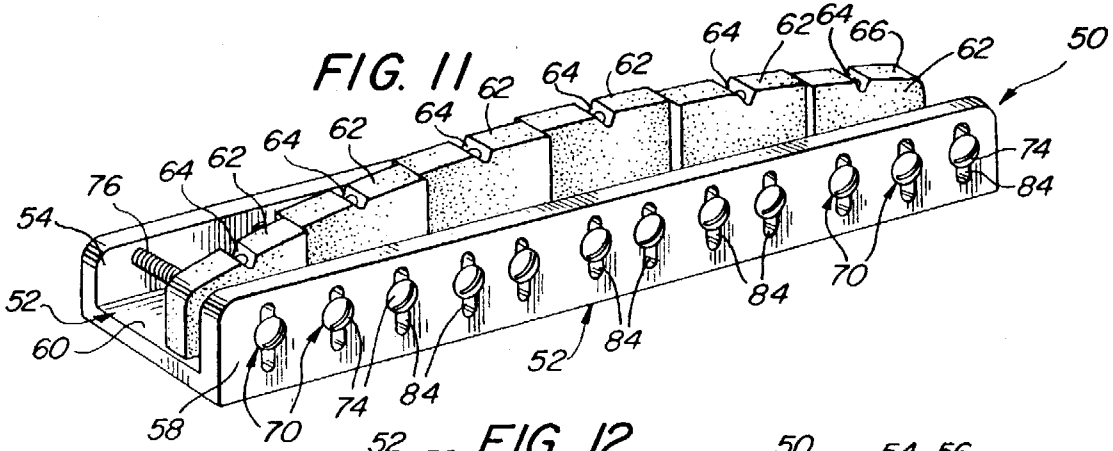
FIG. 11 is a perspective view of another embodiment of the adjustable nut apparatus of the present invention.
Figure 12:
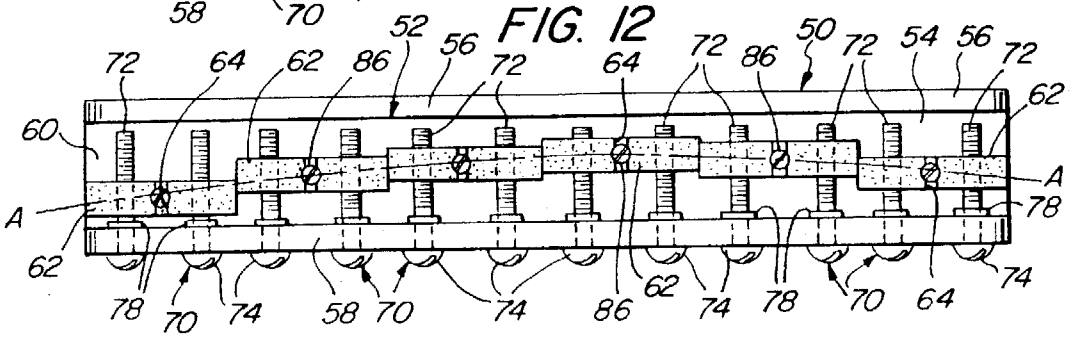
FIG. 12 is an enlarged top-plan view of the adjustable nut as illustrated in FIG. 11.
Figure 13:
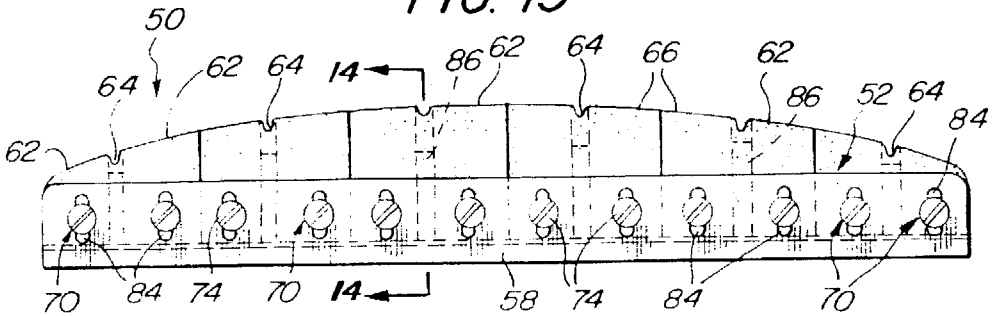
FIG. 13 is a front-elevational view of the adjustable nut illustrated in FIG. 12.

A plurality of adjustable, juxtaposed, saddle nut members 62 are mounted between the front wall 56 and the rear wall 58, wherein each saddle nut includes a groove 64 adapted to receive a respective guitar string. Each saddle member 62 is formed having an arcuate upper edge 66 in which grooves 64 are disposed. Thus, when each saddle member is mounted in channel 54 an overall arc is defined by the plurality of aligned saddle members, as illustrated in FIGS. 11 and 13, wherein each saddle nut 62 is provided with a height greater than the front and rear walls 56 and 58. This allows the guitar strings to seat firmly in the respective notch 64 of each saddle nut 62 without touching either the lower front wall 56 or rear wall 58.

Figure 14:
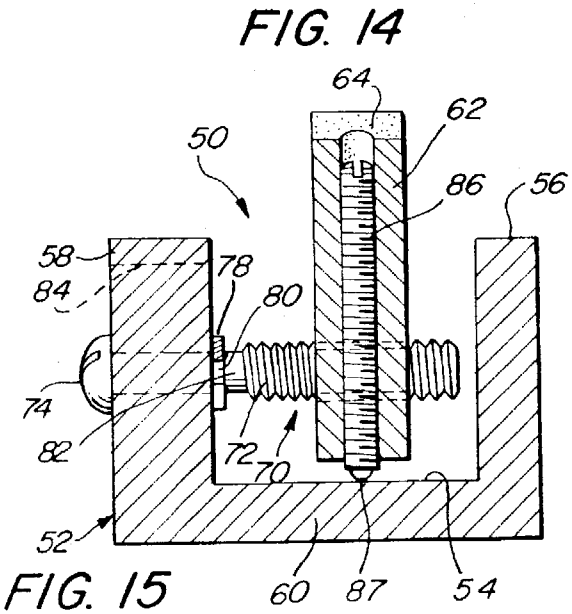
FIG. 14 is an enlarged cross-sectional view taken substantially on line 14—14 of FIG. 13.
Figure 15:
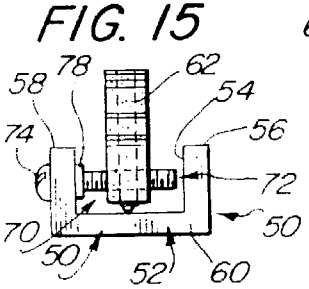
FIG. 15 is a right side-elevational view of the adjustable nut.

Preferably, the saddle nuts 62 will be made from a carbon material or other suitable materials and will include saddle nut adjusting means, generally indicated at 70, which comprises at least two screw members 72 that are rotatably mounted in rear wall 58 and extend toward the front wall 56. A screw head 74 is provided in order to rotate screw 72 within rear wall 58 so that each saddle nut 62 can be readily adjusted transversely within channel 54 during the tuning of each guitar string. Each saddle nut is provided with a pair of screws 72 that are equally spaced apart from the center of the nut and are threadably mounted in the nut. The screws are rotatably mounted in rear wall 58 by means of a holding clip 78 that is positioned with an annular groove 80 formed in the neck 82 of the screw, as illustrated in FIG. 14.

Rear wall 58 is formed having a plurality of vertically arranged slots 84 therein which are adapted to receive neck 82 of screws 72. Accordingly, screw 72 can only be rotated and moved up or down within slot 84 as the height of the saddle nut is adjusted. Thus, it should be noted that each saddle nut 62 is provided with means to rotate about its central vertical axis. This rotating means comprises a vertically adjustable set screw 86 that serves two purposes. One is to provide a vertical pivoting means about which each saddle nut can be rotate relative to its adjacent saddle nut for locking purposes and the other is to provide a height adjusting means for the saddle nuts 62 so as to establish a means to adjust the height of the engaging string as necessary. Once nut 62 is properly positioned relative to the first fret it is held in place by its centrally located set screw 86 which engages base member 60 by means of pointed head member 87. This allows the saddle nut to be adjusted to its proper height for the respective string that is to be received in notch 64 of the saddle nut. When each saddle nut is properly positioned with respect to the height of the respective string and to its relative position to the first fret, the intonation is set. Each adjacent saddle nut is very slightly rotated by turning the two screws 72 on the respective saddle nut so that each abutting edge of each saddle nut will lock or bind against the other in a locking engagement, thereby providing a locking means which locks the nuts in a very firm position and prevents any vibration of the nuts when the strings are being plucked or strummed. Since the adjacent edges of the nuts are closely fitted this binding rotation is very minute and does not affect the setting of the nut or the string that is mounted thereon and prevents any buzzing or rattling at the nut.

The above positioning, arranging and locking in place of the saddle nuts as described above are critical and become a part of the method of tuning the strings of the guitar for this embodiment.

The characteristics and advantages of the invention are further sufficiently referred to in connection with the accompanying drawings, which represent several embodiments. After considering these examples, skilled persons will understand that variations may be made without departing from the principles disclosed; and we contemplate the employment of any structures, arrangements or modes of operation that are properly within the scope of the appended claims.

What I claim is:

1. An adjustable nut apparatus for tuning a guitar comprising:

an elongated nut carriage formed to be positioned transverse the terminating end of a fret board of the guitar, wherein said nut carriage is formed having a front and rear wall and an integral base member;

a plurality of adjustable saddle nut members longitudinally juxtaposed between said front and rear walls; and means for individually adjusting each of said saddle nut members transversely between said front and rear walls, whereby said saddle nut members are selectively positioned for proper tuning of the guitar strings, wherein said means for individually adjusting each of said saddle nut members comprises a pair of adjusting screws rotatably mounted in said rear wall of said nut carriage and threadably mounted to said saddle nut, whereby said saddle nut is selectively positioned between said front and rear walls of said nut carriage.

2. The adjustable nut apparatus as recited in claim 1 including means for vertically adjusting said saddle nut for engaging the respective string mounted thereon, whereby the height of the string is selectively position thereby.

3. The adjustable nut apparatus as recited in claim 2 including:

means for rotatably adjusting said saddle nut about the central axis of said saddle nut; and means for locking said saddle nut in a selected position to prevent movement of said saddle nut.

4. The adjustable nut apparatus as recited in claim 3, wherein said means for rotatably adjusting said saddle nut comprises a set screw mounted in said saddle nut to define the central axis within said saddle nut, and wherein said pair of adjusting screws define said locking means, whereby said saddle nuts are rotatably adjusted for binding engagement with each other.

5. The adjustable nut apparatus as recited in claim 4, wherein the upper edge of each of said front and side walls is located below the upper edges of said saddle nuts, whereby the strings can not engage said front and side walls.

6. The adjustable nut apparatus as recited in claim 4, wherein said rear wall is formed having a plurality of vertical slots disposed therein, whereby said adjustable screws are rotatably mounted in said slots for vertically positioning therein when said saddle nuts are vertically adjusted by said set screw centrally positioned in said saddle nut.

* * * * *